US011819069B2

(12) United States Patent
Carbo, Jr. et al.

(10) Patent No.: US 11,819,069 B2
(45) Date of Patent: Nov. 21, 2023

(54) APPAREL ITEM WITH INTEGRATED LIGHTING SYSTEM

(71) Applicant: NIKE, Inc., Beaverton, OR (US)

(72) Inventors: Jorge E. Carbo, Jr., Aloha, OR (US); Kimberly R. Fisher, Beaverton, OR (US); Alice Fockele, Portland, OR (US); Iustinia Koshkaroff, Portland, OR (US); Amir H. Morgan, Hillsboro, OR (US); Luke A. Pezzimenti, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/897,973

(22) Filed: Aug. 29, 2022

(65) Prior Publication Data

US 2022/0408859 A1 Dec. 29, 2022

Related U.S. Application Data

(63) Continuation of application No. 17/517,034, filed on Nov. 2, 2021, now Pat. No. 11,464,264, which is a (Continued)

(51) Int. Cl.
*A41D 13/01* (2006.01)
*A41D 1/00* (2018.01)

(52) U.S. Cl.
CPC ..... *A41D 13/01* (2013.01); *A41D 1/005* (2013.01)

(58) Field of Classification Search
CPC ..... A41D 13/01; A41D 1/005
See application file for complete search history.

(56) References Cited

U.S. PATENT DOCUMENTS 4,234,907 A 11/1980 Daniel
4,727,603 A 3/1988 Howard
(Continued)

FOREIGN PATENT DOCUMENTS

CN 2329197 Y 7/1999
CN 201640518 U 11/2010
(Continued)

OTHER PUBLICATIONS

Fiber Optic Kits., Fiber Optic Products, Inc., fiberopticproducts.com Available Online at: <http://www.fiberopticproducts.com/Kits.html>, Accessed in 2013., 4 pages.
(Continued)

*Primary Examiner* — Mary Ellen Bowman
(74) *Attorney, Agent, or Firm* — SHOOK, HARDY & BACON L.L.P.

(57) ABSTRACT

Aspects herein are directed to an apparel item having an integrated lighting system and method of forming the apparel item having the integrated lighting system. The integrated lighting system comprises a power supply unit affixed to the apparel item, one or more light arrays having visible light sources affixed to the apparel item, and one or more conductive traces affixed to the apparel item, where the conductive traces extend from the power supply unit to the light arrays and electrically couple the two such that the light arrays are powered when the power supply unit is operating.

20 Claims, 9 Drawing Sheets

Related U.S. Application Data continuation of application No. 17/147,159, filed on Jan. 12, 2021, now Pat. No. 11,185,116, which is a continuation of application No. 16/864,397, filed on May 1, 2020, now Pat. No. 10,966,470, which is a continuation of application No. 16/315,813, filed as application No. PCT/US2017/040221 on Jun. 30, 2017, now Pat. No. 10,701,990.

(60) Provisional application No. 62/359,879, filed on Jul. 8, 2016, provisional application No. 62/356,960, filed on Jun. 30, 2016.

(56) References Cited

U.S. PATENT DOCUMENTS

| | | | | |
|---|---|---|---|---|
| 4,754,372 | A | 6/1988 | Harrison | |
| 5,502,903 | A | 4/1996 | Barker | |
| 5,649,755 | A | 7/1997 | Rapisarda | |
| 5,921,674 | A | 7/1999 | Koczi | |
| 7,168,862 | B2 | 1/2007 | Qi et al. | |
| 8,376,564 | B2 | 2/2013 | Finn | |
| 10,493,352 | B2 | 12/2019 | Beneyto-ferre | |
| 2004/0015117 | A1* | 1/2004 | Gauthier | A63B 71/1225 602/62 |
| 2005/0095406 | A1 | 5/2005 | Gunzel et al. | |
| 2010/0029157 | A1 | 2/2010 | Brochier et al. | |
| 2011/0075399 | A1* | 3/2011 | Yuan | A41D 13/01 362/103 |
| 2011/0235311 | A1 | 9/2011 | Stone | |
| 2013/0010004 | A1 | 1/2013 | Ligorano et al. | |
| 2013/0031694 | A1* | 2/2013 | Foster | A41D 27/08 2/69 |
| 2014/0259269 | A1 | 9/2014 | Clements | |
| 2017/0074621 | A1* | 3/2017 | Provencal | A41D 31/08 |
| 2019/0200690 | A1 | 7/2019 | Carbo et al. | |
| 2020/0253298 | A1 | 8/2020 | Carbo et al. | |
| 2021/0127763 | A1 | 5/2021 | Fisher et al. | |
| 2022/0053845 | A1 | 2/2022 | Fisher et al. | |

FOREIGN PATENT DOCUMENTS

| | | | | |
|---|---|---|---|---|
| CN | 203058322 | U | 7/2013 | |
| CN | 204763503 | U | 11/2015 | |
| CN | 204930432 | U | 1/2016 | |
| DE | 3430716 | A1 | 3/1986 | |
| EP | 2472297 | A1 | 7/2012 | |
| FR | 2788105 | A1 | 7/2000 | |
| KR | 20-0424918 | Y1 | 8/2006 | |
| WO | 00/52385 | A1 | 9/2000 | |
| WO | 03/007740 | A2 | 1/2003 | |
| WO | 2005/039338 | A1 | 5/2005 | |
| WO | 2011/082420 | A1 | 7/2011 | |
| WO | 2016/074689 | A1 | 5/2016 | |
| WO | WO-2016074689 | A1 * | 5/2016 | A41D 1/002 |
| WO | 2016/122400 | A1 | 8/2016 | |
| WO | 2018/005932 | A1 | 1/2018 | |

OTHER PUBLICATIONS

Led Lighting Belly Dance Wing Isis Wing Costume With Fiber Optical Fabric Rgb Changeable Colors Remote Control, Ali Express™, aliexpress.com Available Online at : <http://www.aliexpress.com/item/LED-lighting-belly-dance-wing-isis-wing-costume-with-1ber-optical-fabric-RGB-changeable-colors-remote/32216401998.html>, Accessed on Mar. 23, 2020, 1 page.

Luminous items for Marketing & Advertising, Fiber Optic Logos & Signages, LumiGram®, lumigram.com. Available Online at: <http://www.lumigram.com/catalog/P4_1LLUMINATED_FABRIC_LOGO.php>, Accessed in 2013., 2 pages.

The_Gella,"Lightwings: Fiber Optic Fairy Wings Step 7: Connect battery holder to LEDs", instructables, instructables.com, Available Online at: <http://www.instructables.com/id-/Lightwings-Fiber-Optic-Fairy-Wings/step7/Connect-battery-holder-to-LEDs/>, Accessed in 2015., 2 pages.

Office Action received for European Patent Application No. 21192132.5, dated Jun. 2, 2023, 5 pages.

* cited by examiner

APPAREL ITEM WITH INTEGRATED LIGHTING SYSTEM

CROSS-REFERENCE TO RELATED APPLICATIONS AND PRIORITY CLAIM

This Application, entitled "Apparel Item with Integrated Lighting System" is a continuation application of U.S. patent application Ser. No. 17/517,034 filed on Nov. 2, 2021 and entitled "Apparel Item with Integrated Lighting System"; which is a continuation application of U.S. patent application Ser. No. 17/147,159, issued as U.S. Pat. No. 11,185,116, filed on Jan. 12, 2021 and entitled "Apparel Item with Integrated Lighting System"; which is a continuation application of U.S. patent application Ser. No. 16/864,397, issued as U.S. Pat. No. 10,966,470, filed on May 1, 2020, and entitled "Apparel Item with Integrated Lighting System"; which is a continuation application of U.S. patent application Ser. No. 16/315,813, issued as U.S. Pat. No. 10,701,990, filed on Jan. 7, 2019, and entitled "Apparel Item with Integrated Lighting System"; which is a 35 U.S.C. § 371 application of PCT Application No. PCT/US2017/040221, filed Jun. 30, 2017, and entitled "Apparel Item with Integrated Lighting System"; which claims priority to both U.S. Provisional Application No. 62/356,960, filed Jun. 30, 2016, and entitled "Apparel Item with Integrated Lighting System" and U.S. Provisional Application No. 62/359,879, filed Jul. 8, 2016, and entitled "Apparel Item with Integrated Lighting System." The entireties of the aforementioned applications are incorporated by reference herein.

TECHNICAL FIELD

Aspects herein are directed to an apparel item having an integrated lighting system.

BACKGROUND

Apparel items may utilize integrated lighting systems to provide visibility. Integrating the lighting system into the apparel item while maintaining the functionality of the apparel item may be challenging.

BRIEF DESCRIPTION OF THE DRAWINGS

Examples of the present invention are described in detail below with reference to the attached drawing figures, wherein.

DETAILED DESCRIPTION

Figure 1:
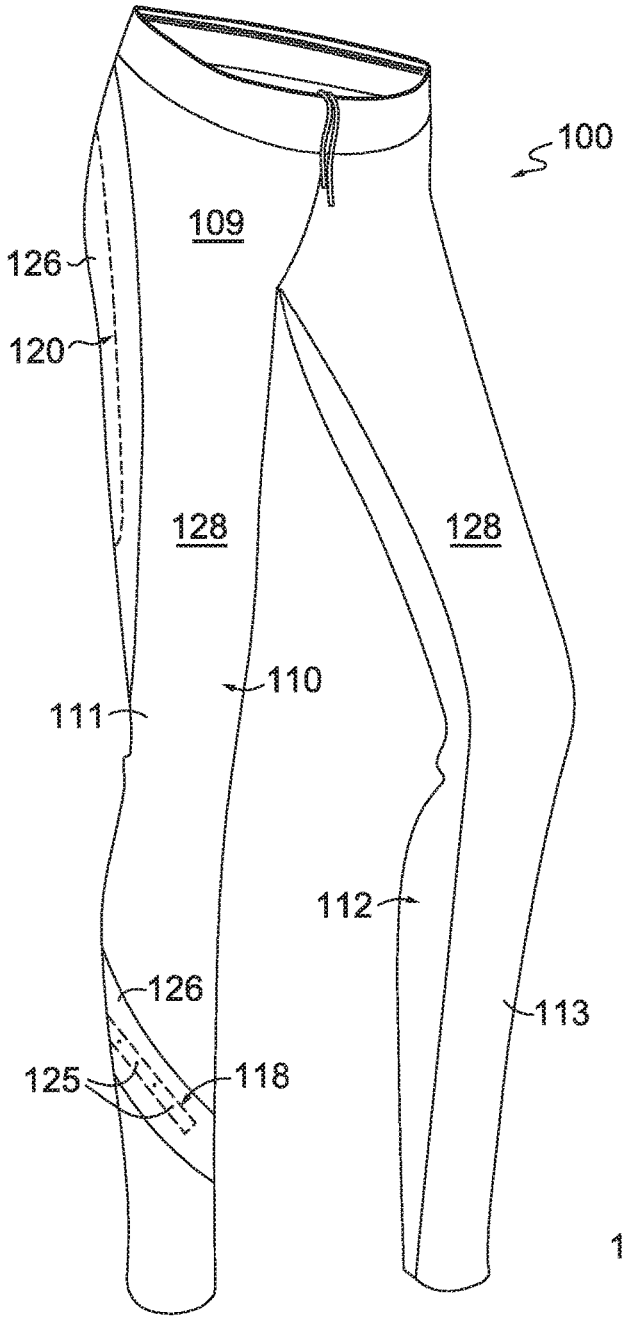
FIG. 1 illustrates a front perspective view of an exemplary apparel item with an integrated lighting system in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein provide for an apparel item having an integrated lighting system comprising one or more visible light sources that provides visibility to the apparel item, and its wearer, in low light conditions such as early morning, dusk, and at night. This is especially important for those wearers that engage in outdoor athletic activities, such as running, during these hours. An integrated lighting system provides advantages over traditional reflective materials because they allow the wearer of the apparel item to be visible even when not directly illuminated. An exemplary integrated lighting system may comprise, for instance, a power supply unit affixed to the apparel item, one or more light arrays having visible light sources affixed to the apparel item, and one or more conductive traces affixed to the apparel item, where the conductive traces extend from the power supply unit to the light arrays and electrically couple the two such that the light arrays are powered when the power supply unit is operating.

In one aspect, an apparel system having an integrated lighting system is provided. For instance, the apparel system may comprise a base or mid-layer having an integrated lighting system comprising one or more visible light sources positioned at predetermined locations on the base or mid-layer as described below. In an exemplary aspect, the base layer may be worn by itself to provide visibility to the wearer. In another example, when in the form of a mid-layer, the mid-layer may be worn over a base layer to provide visibility to the wearer. The system may further comprise an outer shell layer configured to be worn over the base or mid-layer where all or portions of the outer shell layer are formed from a transparent material, a translucent material, or a nearly translucent material. The outer shell layer may help to provide protection from the elements such as rain, cold, and/or wind. When worn over the base or mid-layer, the transparent/translucent material of the outer shell layer is configured to be positioned adjacent to the visible light sources enabling the light sources to be visible. In one example, the outer shell layer may be formed of a substantially opaque material in some areas and a substantially transparent/translucent material in other areas. The location of the substantially transparent/translucent material on the outer shell layer may be dependent upon the location of the light arrays on the base or mid-layer such that when the outer shell layer is worn over the base or mid-layer, the translucent material is positioned adjacent to the light arrays.

In another exemplary aspect, reflective materials (i.e., reflective strips, reflective prints, and the like) may be positioned on the base or mid-layer and/or on the outer shell layer where they can be used in conjunction with the integrated lighting system to provide further visibility to the wearer. In one exemplary aspect, the visible light sources may be positioned at the distal ends of the extremity portions of the base or mid-layer such as at the wrist area or ankle area, and the reflective materials may be positioned at other "joint" areas of the outer shell layer and/or the base or mid-layer such as at the elbow, shoulder, knee, or hip areas although it is also contemplated that the reflective materials may be positioned at the wrist or ankle areas adjacent to the visible light sources. It may be useful to position the visible light sources and the reflective materials at these "joint" areas as these areas typically undergo a greater degree of movement as compared to, for instance, the torso portion of an apparel item when the wearer is, for instance, running and, in turn, are more likely to draw attention to the wearer.

Continuing, the location of the reflective materials on the base or mid-layer may be different from the location of the reflective materials on the outer shell layer, where the location of both may correspond to joint areas of the respective apparel items. As an example, when the base or mid-layer is in the form of a shirt or top, a visible light source may be positioned at a wrist area of the base or mid-layer, a reflective material may be positioned at an elbow area of the base or mid-layer, and a second reflective material may be positioned at a shoulder area of the outer shell layer. Since the outer shell layer is substantially transparent or translucent, both reflective materials, as well as the visible light source, may be visible when the outer shell layer is worn over the base or mid-layer. And because the reflective materials are located at different joint areas, visibility of the apparel system is enhanced.

In another exemplary aspect, when the base or mid-layer is in the form of a tight or pant, a visible light source may be positioned at an ankle area of the base or mid-layer, a first reflective material may be positioned at the knee area of the base or mid-layer, and a second reflective material may be positioned at a hip area of the outer shell layer. Since the outer shell layer is substantially transparent or translucent, both reflective materials, as well as the visible light source positioned at the ankle area of the base or mid-layer, may be visible when the outer shell layer is worn over the base or mid-layer.

The configurations of the light arrays and the reflective materials described above are exemplary only and it is contemplated herein that other configurations may be utilized. For instance, the base or mid-layer may comprise just light arrays without reflective materials. And reflective materials may be utilized on the base or mid-layer and/or on the outer shell layer at other locations than those described. Any and all aspects, and any variation thereof, are contemplated as being within aspects herein.

In an exemplary aspect, the lighting system comprises one or more light arrays that are positioned on the apparel item at predetermined locations to enable recognition of the wearer as a human. In other words, the light arrays are positioned on the apparel item such that a person viewing the wearer would recognize the wearer as human as opposed to an inanimate object or an animal especially in low light conditions. By way of example, to enable human recognition, the visible light arrays may be positioned on the sleeve or leg portions of the apparel item near or at the terminal ends of the sleeve and leg portions such that they extend from a posterior aspect, around the lateral aspect, and to the anterior aspect of the sleeve or leg portions. Moreover, when the apparel item is in the form of a shirt or top, an additional light array may be positioned in the center back of the apparel item. This particular light array may act as a somewhat stationary focal or reference point that provides context for the lights sources positioned on the leg and sleeve portions as these light sources will generally be moving due to the wearer's arm and leg motions during, for instance, running. In other words, the stationary light array would give an indication of the height of the wearer and the light arrays positioned on the sleeve and/or leg portions would give an indication that the wearer is moving. By using both of these locations, recognition that the wearer is human is further enhanced.

In an additional aspect, a method of forming an apparel item having an integrated lighting system is provided. The method described below facilitates easier construction of the apparel item thereby reducing manufacturing costs. At a high level, the components of the lighting system are applied to a panel of material, and the panel of material is subsequently joined to one or more additional panels of materials to form the apparel item. By constructing the apparel item in this way, instead of applying the components of the lighting system to the finished or already-formed apparel item, easier construction is achieved. An apparel item constructed by this method, for instance, may comprise a panel of material to which the components of the lighting system are applied and one or more additional panels of material that are devoid of any lighting components.

In yet another exemplary aspect, a double-layer construction is contemplated for an apparel item having an integrated lighting system. The double-layer construction helps to improve wearer comfort and to "hide" the components of the integrated lighting system. This may be especially useful in athletic apparel which is often form fitting. In some constructions where lighting components are applied to the inner-facing surface of a single layer of material, the outlines or impressions of the conductive traces and/or the light arrays may be visible when viewing the apparel item from its outer-facing surface thus providing an undesirable aesthetic to the apparel item. Moreover, a single layer construction may prove to be uncomfortable to the wearer as the lighting components may be positioned directly adjacent to the wearer's skin surface. To help hide the components and to improve wearer comfort, a double-layer construction is contemplated where the lighting components are positioned in the space or void formed between the two layers. More specifically, when using a first "outer" panel and a second "inner" panel, the conductive traces may mainly be affixed to the second inner panel and the light array may be affixed to the first outer panel such that the light sources of the array may be visible through one or more openings formed in the outer panel. To create an electrical connection between the conductive traces and the light array, a terminal end portion of the conductive traces may be brought up to the outer panel and coupled to the light array. By primarily positioning the conductive traces on the inner panel, the conductive traces are effectively hidden by the outer panel. It is also contemplated that the conductive traces and the light array may both be affixed to the inner panel and a mesh material may be used in at least portions of the outer panel that are positioned adjacent to the light array to enable the light sources to be visible.

Aspects herein further relate to a conductive trace configuration that reduces the number of conductive traces that are connected to a power supply unit of the lighting system. As set forth above, each light array is electrically coupled to a pair of conductive traces (e.g., a positive trace and a negative trace), which in turn are connected to a power supply unit. When multiple light arrays are used on the apparel item, a large number of conductive traces may be connected to the power supply unit which may not only be cumbersome, but may reduce the pliability of the apparel item in the area where the multiple traces are located, increase the weight of the apparel item, and prove to be aesthetically displeasing and uncomfortable to the wearer. Aspects herein provide for one or more junction areas on the apparel item that enable a single set of conductive traces to extend from the power supply unit where the single set of conductive traces are electrically coupled to additional traces at the junction area. The additional traces, in turn, may be electrically coupled to two or more light arrays.

Continuing, more specifically, a single pair of conductive traces may extend from a power supply unit to a junction area located at a different area of the apparel item than the power supply unit. The junction area may comprise a first junction structure where the negative trace of the pair of conductive traces may be electrically coupled to at least a second and a third negative trace. Similarly, the junction area may further comprise a second junction structure where the positive trace of the pair of conductive traces may be electrically coupled to at least a fourth and a fifth positive trace. In exemplary aspects, the second and the fourth conductive traces may be electrically coupled to a first light array, and the third and fifth conductive traces may be electrically coupled to a second light array.

Each junction structure may comprise, for instance, an electrically conductive material positioned between a first and second electrically insulating layer, which, in exemplary aspects, may comprise a polymer layer. The conductive material may comprise a conductive fabric, a conductive ink, a conductive epoxy, and the like. One or more channels or openings may be formed in the conductive material for receiving the end portions of the conductive traces. It is contemplated that the junction structures may be formed independently of an apparel item and may be applied to the apparel item when needed. For instance one of the polymer layers may be positioned adjacent the fabric of the apparel item and a heat bonding process may be used to seal the junction structure and secure it to the fabric.

Figure 2:
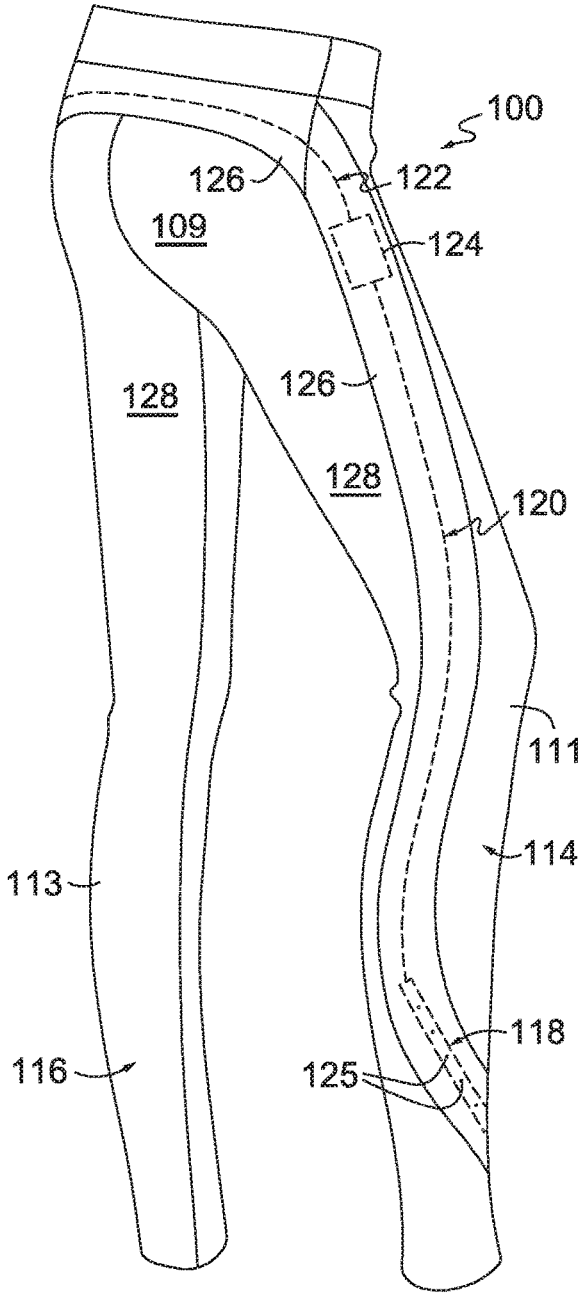
FIG. 2 illustrates a back perspective view of the exemplary apparel item of FIG. 1 in accordance with aspects herein.

Turning now to FIGS. 1 and 2, front and back perspective views respectively of an exemplary apparel item 100 having an integrated lighting system are provided in accordance with aspects herein. With respect to the figures in this disclosure, the components of the lighting system are shown as dashed lines to indicate that they are generally located on an interior aspect of the apparel item and are "hidden" from view. The apparel item 100 is in the form of a pair of pants in an as-worn configuration although it is contemplated herein that the apparel item 100 may be in the form of a tight, and/or a three-quarter tight or pant. The apparel item 100 comprises an anterior and posterior torso portion 109 adapted to cover a lower torso area of a wearer when the apparel item 100 is in the as-worn configuration. The apparel item 100 further comprises a first leg portion 111 and a second leg portion 113 each having an anterior aspect 110, a posterior aspect 116, a medial aspect 112, and a lateral aspect 114 with these terms being given their common anatomical meaning. The apparel item 100 further comprises a first light array 118, a first set of conductive traces 120, a second set of conductive traces 122, and a power supply unit 124. Although not shown, the apparel item 100 may further comprise a second light array positioned on the second leg portion 113 in a similar area as the first light array 118.

With respect to the first light array 118, the light array 118 may comprise, for instance, a plurality of discrete visible light sources 125 (e.g., LED, OLED, an electroluminescent material, and the like) arranged in, for instance, a single line of lights or two or more rows of lights. In exemplary aspects, the light sources 125 may be electrically coupled to an electrical circuit such as a printed electrical circuit or a lithographically etched electrical circuit, where the electrical circuit may control the brightness of the visible light sources, the number of light sources that emit light at any given time, and the like. The light array 118 may also comprise a continuous line of lights using, for instance, a fiber optic light and/or an optical fiber. The light array 118 is configured to be, thin, bendable, and flexible so as to conform to body curvatures when the apparel item 100 is worn. The light array 118 may be affixed to the apparel item using, for instance, a polymer layer such as a thermoplastic polyurethane (TPU) or a silicone-based polymer.

In exemplary aspects, the light array 118 is positioned on the apparel item 100 such that a first end of the light array 118 is positioned on the posterior aspect 116 of the first leg portion 111, a second end of the light array 118 is positioned on the anterior aspect 110 of the first leg portion 111, and the portion of the light array 118 that extends between the two ends (e.g., the intervening portion) is positioned on the lateral aspect 114 of the first leg portion 111. Moreover, the light array 118 is positioned adjacent (i.e., within 12 to 15 inches) to the bottom margin of the first leg portion 111 (e.g., near the ankle area of the wearer). This area of the apparel item 100 may exhibit greater movement than other areas of the apparel item 100 during, for instance, a running motion when worn by a wearer.

By positioning the light array 118 as described, the light sources 125 are visible when viewing the wearer from the front, from the back, and from the sides. This combined with the movement of the light sources 125 when the wearer is running helps to enable recognition of the wearer as a human. Although positioned just at the ankle area of the apparel item 100, light arrays may also be located at other areas of the apparel item 100 that are positioned adjacent to, for example, joint areas of the wearer such as the knee area or the hip area of the apparel item 100. Alternatively, or in addition to, reflective materials may be used at the hip or knee area to further increase visibility of the wearer.

The first set of conductive traces 120 may comprise a positive trace and a negative trace each having a first end that is electrically coupled to the first light array 118 and a second end that is electrically coupled to the power supply unit 124. An intervening portion extends between the first and second ends of the first set of conductive traces 120. The conductive traces 120 may comprise, for instance, a flexible conductive wire, a flexible conductive yarn, a screen-printed conductive path, and the like. In an alternative aspect, the conductive traces may be fiber optic cables or fibers configured to transmit data and/or light. The conductive traces 120 may be secured to an inner-facing aspect of the apparel item 100 using a polymer layer such as an electrically insulating polymer layer (e.g., TPU or silicone-based polymer). The apparel item 100 further comprises the second set of conductive traces 126 that extend from the power supply unit 124 to the second light array (not shown due to the perspective view of FIGS. 1 and 2) positioned at the ankle area of the second leg portion 113.

Although shown in dashed lines, it is contemplated that the power supply unit 124 may be located on the inner or outer-facing surface of the apparel item 10 or a combination of both. The power supply unit 124 may be configured to transmit power and/or data through the conductive traces 120 and 126. In one aspect, the power supply unit 124 may also be configured as a light emitting device that transmits light through the conductive traces 120 and/or 126 when the conductive traces 120 and/or 126 are in the form of fiber optic cables or fibers. In yet another aspect, when the light array 118 is configured as a fiber optic cable and the power supply unit 124 is configured as a light emitting device, the light array 118 may be coupled directly to the power supply unit 124. Any and all aspects, and any variation thereof, are contemplated as being within aspects herein.

Continuing, the power supply unit 124 may comprise a hub affixed to the apparel item and into which the actual power unit may be releasably positioned (i.e., it may be inserted when needed and removed when, for instance, the apparel item 100 is washed). In an exemplary aspect, the power supply unit 124 may be positioned on the lateral aspect 114 of the torso portion 109 near the upper margin of the apparel item 100 such that it is positioned adjacent to a hip area of the wearer when the apparel item 100 is worn. This location provides easy access to the wearer. Other locations are contemplated herein.

As shown in FIGS. 1 and 2, the components of the lighting system such as the light array 118, the first and second sets of conductive traces 120 and 126, and the power supply unit 124 are all positioned on a panel of material 126. As used throughout this disclosure, the term panel of material may mean a panel of unitary construction formed without seams, or it may mean a panel of material formed using one or more sub-panels that are joined together using affixing technologies such as stitching, bonding, welding, and the like. In exemplary aspects, the panel of material 126 is formed and the components of the lighting system are applied to the panel of material 126 before joining or affixing the panel of material 126 with one or more additional panels, such as the panels 128 to form the apparel item 100. As described above, this helps to simplify the construction process as it may be more difficult to apply the lighting system components to an already-constructed apparel item. In exemplary aspects, the panels 128 may be devoid of any lighting components. Further, in exemplary aspects, the panels 128 may form the majority (e.g., greater than 50%, 60%, 70%, or 80%) of the apparel item 100, and the panel of material 126 may form the minority (e.g., less than 50%, 40%, 30%, or 20%) of the apparel item 100. By limiting the lighting components to a single panel of material, conductive traces do not extend over all different portions of the apparel item which increases the usability and durability of the apparel item.

Figure 4:
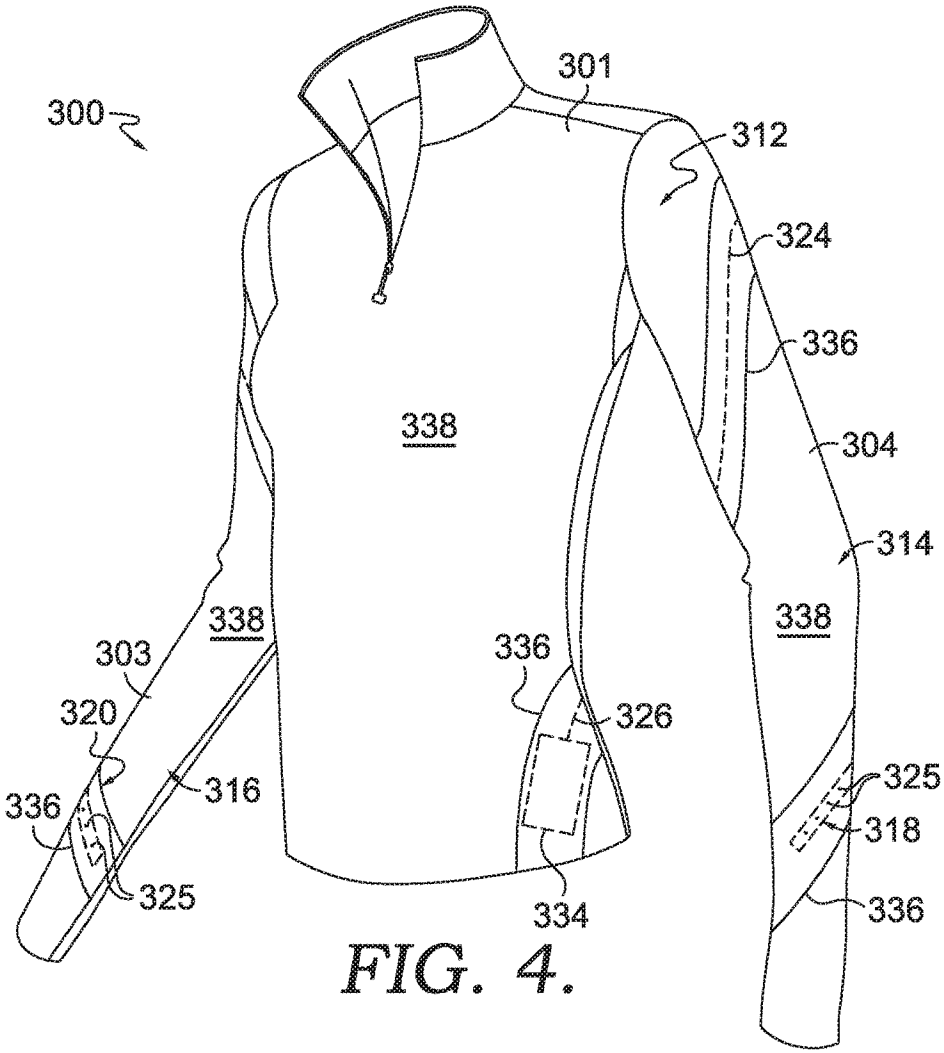
FIG. 4 illustrates a front perspective view of the exemplary apparel item of FIG. 3 in accordance with aspects herein.
Figure 3:
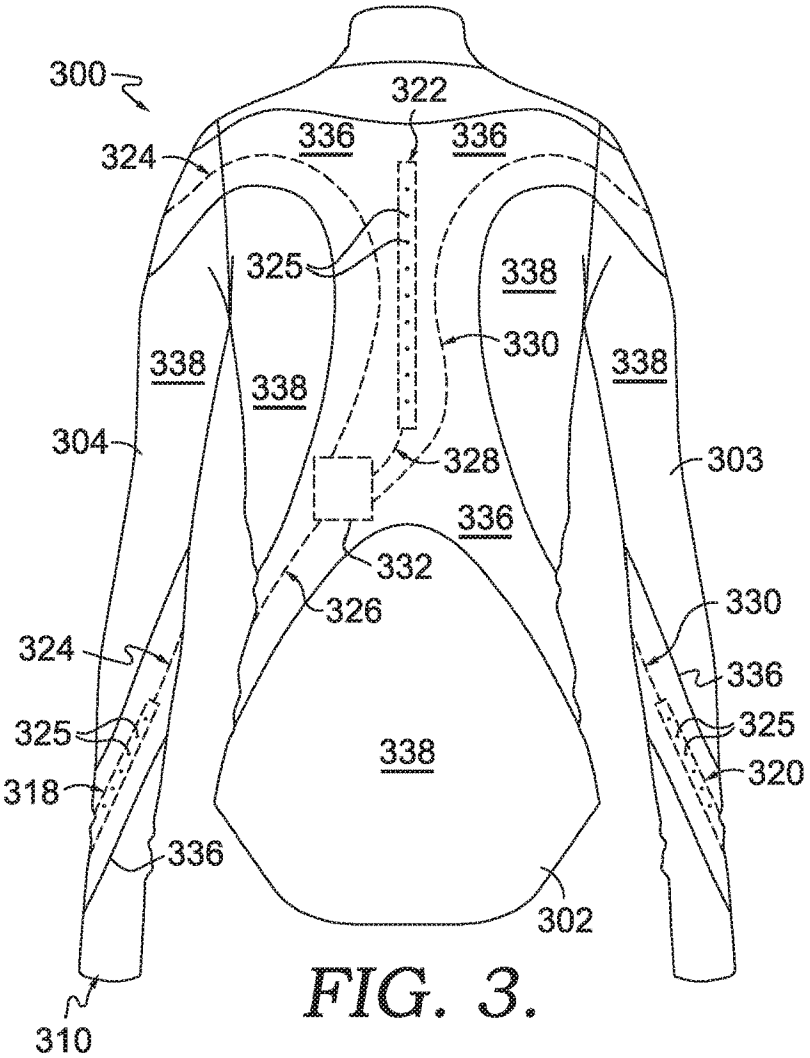
FIG. 3 illustrates a back view of an exemplary apparel item with an integrated lighting system in accordance with aspects herein.

Turning now to FIGS. 3 and 4, a back view and a front perspective view respectively of an apparel item 300 are provided in accordance with aspects herein. The apparel item 300 is in the form of a long-sleeved top although it is contemplated herein that the apparel item 300 may be in the form of a jacket, a hoodie, a sweatshirt, and the like. The apparel item 300 comprises an anterior torso portion 301, a posterior torso portion 302, a first sleeve portion 303, and a second sleeve portion 304. The first and second sleeve portions 303 and 304 each comprise a posterior aspect 310, an anterior aspect 312, a lateral aspect 314, and a medial aspect 316. With respect to the sleeve portions 303 and 304, the terms anterior, posterior, lateral, and medial are with respect to the arms of a hypothetical wearer positioned so that the wearer's thumbs are facing forward.

A first light array 318 having visible light sources 325 is positioned near the terminal end (e.g., within 6 to 12 inches of the terminal end) of the first sleeve portion 303, and a second light array 320 having visible light sources 325 is positioned near the terminal end of the second sleeve portion 304. These areas of the sleeve portions 303 and 304 generally experience a high degree of movement when the apparel item 300 is worn and the wearer is performing a running motion. Further, the first light array 318 is positioned on the first sleeve portion 303 such that a first end of the first light array 318 is positioned on the posterior aspect 310 of the sleeve portion 303, a second end of the first light array 318 is positioned on the anterior aspect 312 of the sleeve portion 303, and the portion of the light array 318 extending between the first and second ends is positioned on the lateral aspect 314 of the sleeve portion 303. Similarly, the second light array 320 is positioned on the second sleeve portion 304 such that a first end of the second light array 320 is positioned on the posterior aspect 310 of the sleeve portion 304, a second end of the second light array 320 is positioned on the anterior aspect 312 of the sleeve portion 304, and the portion of the light array 320 extending between the first and second ends is positioned on the lateral aspect 314 of the second sleeve portion 304.

By positioning the first and second light arrays 318 and 320 as described, a person viewing the wearer of the apparel item 300 would see the visible light sources 325 from the front, the back, and the sides of the wearer especially in low light conditions. Moreover, because the light arrays 318 and 320 are positioned in areas of high movement, human recognition of the wearer is facilitated. Although positioned just at the terminal ends or wrist areas of the apparel item 300, light arrays may also be located at other areas of the sleeve portions 303 and 304 such as adjacent to joint areas of the wearer such as the elbow area or the shoulder are of the sleeve portions 303 and 304. Alternatively, or in addition to, reflective materials may be used at these areas to further increase visibility of the wearer.

The apparel item 300 may further comprise a third light array 322 positioned, in one exemplary aspect, in a central area of the posterior torso portion 302 of the apparel item 300 where the third light array 322 comprises visible light sources 325. The third light array 322 may be positioned in a vertical orientation at an upper portion of the posterior torso portion 302 although other locations are contemplated such as a vertical orientation at a lower portion of the posterior torso portion 302 near the bottom margin of the apparel item 300, and/or in a horizontal orientation at the upper or lower portion of the posterior torso portion 302 of the apparel item 300. Since these areas of the apparel item 300 generally undergo little movement during, for example, a running motion by the wearer, the light array 322 may act as a stationary or somewhat stationary reference point when a person views the apparel item 300 from behind or from the side. To put it another way, the light array 322 may act as a reference point by which the movement of the light arrays 318 and 320 in response to a running motion by the wearer may be compared. Thus, the combination of the three light arrays 318, 320, and 322 work together to facilitate the recognition of the wearer as a human.

As shown in FIG. 4, the apparel item 300 comprises a power supply unit 334 that, in one exemplary aspect, is positioned adjacent (i.e., within 1 to 8 inches) to a lower margin of the anterior torso portion 301 of the apparel item 300 where it may be readily accessible to the wearer. In one exemplary aspect, a single set of conductive traces 326 are electrically coupled to the power supply unit 334 and extend to the posterior torso portion 302 of the apparel item 300 where they may terminate at a junction area 332. More details concerning the junction area 332 will be provided below with respect to FIGS. 7 and 8. A second, third, and fourth set of conductive traces 324, 328, and 330 respectively extend from the junction area 332. The second set of conductive traces 324 extend to the first light array 318 to which they are electrically coupled. The second set of conductive traces 328 extend to the third light array 322 to which they are electrically coupled. And the third set of conductive traces 330 extend to the second light array 330 to which they are electrically coupled.

As shown in FIGS. 3 and 4, the components of the lighting system such as the light arrays 318, 320 and 322, the first, second, third and fourth conductive traces 326, 324, 328, and 330, and the power supply unit 334 are all positioned on a panel of material 336. Similar to the apparel item 100, the panel of material 336 is formed and the components of the lighting system are applied to the panel of material 336 before joining the panel of material 336 with one or more additional panels, such as the panels 338 to form the apparel item 300. As described above, this helps to simplify the construction process as it may be more difficult to apply the lighting system components to an already-constructed apparel item. In exemplary aspects, the panels 338 may be devoid of or lack any lighting components. Further, in exemplary aspects, the panels 338 may form the majority (e.g., greater than 50%, greater than 60%, greater than 70%, or greater than 80%) of the apparel item 300, and the panel of material 336 may form the minority (e.g., less than 50%, less than 40%, less than 30%, or less than 20%) of the apparel item 300.

Figure 5:
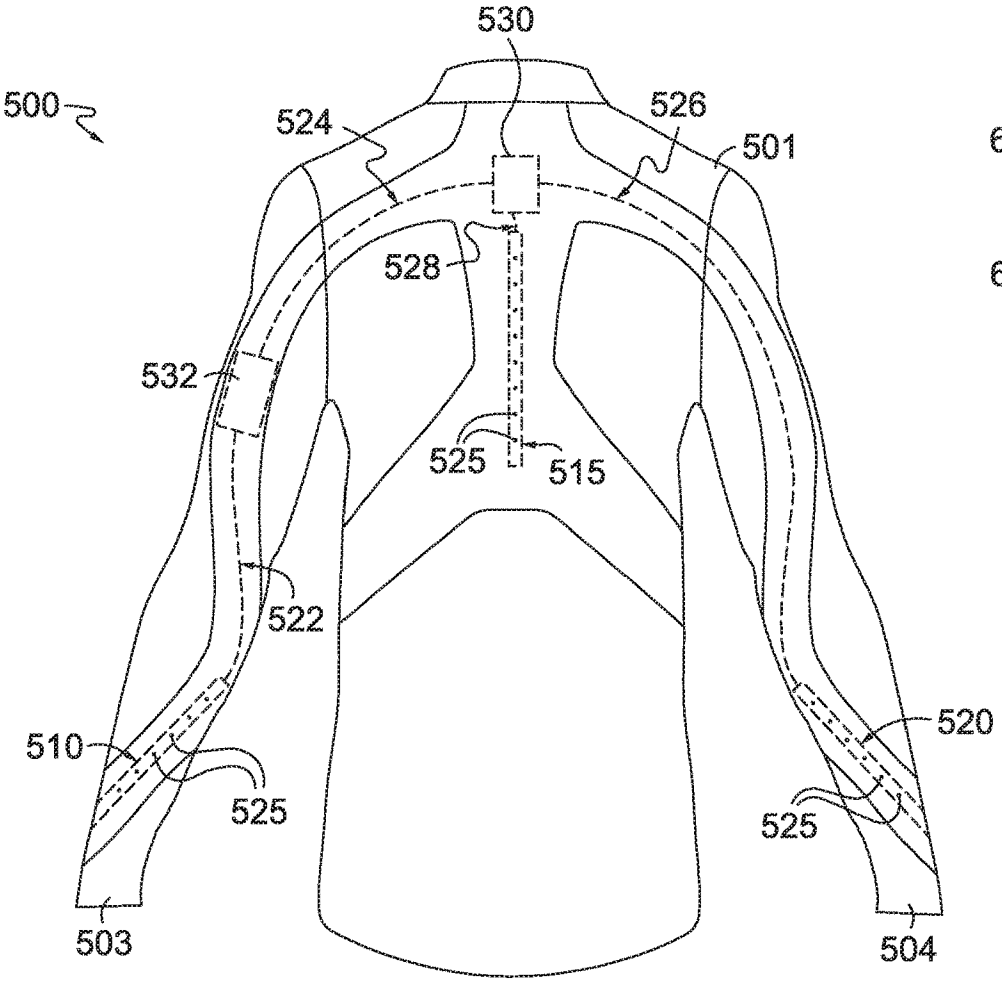
FIG. 5 illustrates a back view of an exemplary apparel item with an integrated lighting system in accordance with aspects herein.

FIG. 5, which illustrates a back view of an exemplary apparel item 500, depicts a different configuration of conductive traces and a different placement of the power supply unit. The apparel item 500 is in the form of a shirt or top and, similar to the apparel item 300, comprises a first light array 510 having visible light sources 525 positioned on a first sleeve portion 503, a second light array 520 having visible light sources 525 positioned on a second sleeve portion 504, and a third light array 515 having visible light sources 525 positioned on a posterior torso portion 501 of the apparel item 500. The location of the light arrays 510, 515, and 520 on the apparel item 500 are similar to the location of the light arrays 318, 320, and 322 on the apparel item 300.

The apparel item 500 comprises a power supply unit 522 which, in an exemplary aspect, may be located on the first sleeve portion 503 of the apparel item 500, although it is contemplated herein that the power supply unit 522 may alternatively be located on the second sleeve portion 504. As shown in FIG. 5, for example, the power supply unit 532 may be located on a posterior aspect of the first sleeve portion 503 at an upper portion of the first sleeve portion 503 such that is can be easily accessed by the wearer. A first set of conductive traces 522, which are electrically coupled to the power supply unit 532, extend to the first light array 510. A second set of conductive traces 524, which are also electrically coupled to the power supply unit 532, extend to a junction area 530 located on the posterior torso portion 501 of the apparel item 500. From the junction area 530, a third set of conductive traces 528 extend and are electrically coupled to the third light array 515. Further, from the junction area 530, a fourth set of conductive traces 526 extend and are electrically coupled to the second light array 520.

The placement of the power supply unit on the apparel items 100, 300 and 500 is variable and may differ from the locations shown for the apparel items 100, 300, and 500. In general, the power supply unit is positioned in an area that is easily accessible to the wearer. The placement of the power supply unit, in turn, may influence the particular configuration of the conductive traces.

Figure 6A:
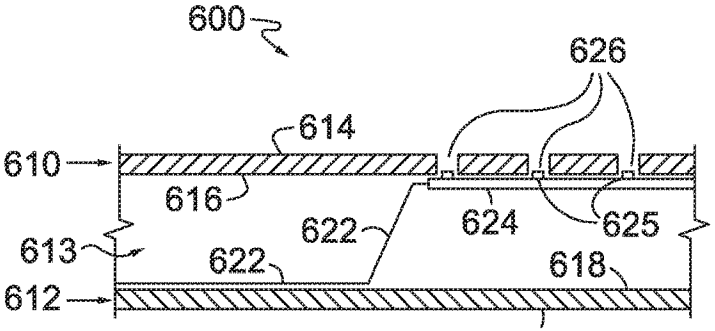
FIG. 6A illustrates a cross-sectional view of an exemplary configuration of conductive traces and a light array as positioned on a bi-layered panel of material in accordance with aspects herein.

Turning now to FIG. 6A, a cross-sectional view of a panel of material 600 comprising lighting components is provided in accordance with aspects herein. The panel of material 600 may represent, for instance, the panel of material 126 of the apparel item 100, and/or the panel of material 336 of the apparel item 300. In exemplary aspects, the panel of material 600 may comprises a first layer 610 having a first surface 614 and a second surface 616 opposite the first surface 614. The panel of material 600 may further comprise a second layer 612 having a third surface 618 and a fourth surface 620 opposite the third surface 618. As such, the panel of material 600 may comprise a bi-layer construction with a void or space 613 between the two layers 610 and 612 and with the second surface 616 being positioned adjacent to the third surface 618 when the panel of material 600 is assembled. One exemplary way of assembling the first and second layers 610 and 612 is by affixing the layers 610 and 612 together along their perimeter edges.

As shown in FIG. 6A, components of the integrated lighting system such as conductive traces 622 and a light array 624 having discrete visible light sources 625 may be positioned in the space 613 between the two layers 610 and 612. In one example, the conductive traces 622, which may be the conductive traces 120 or 126 of the apparel item 100, or the conductive traces 324, 328, or 330 of the apparel item 300, may be affixed or secured to the third surface 618 of the second layer 612 such that a majority (greater than 50%, 60%, 70%, 80%, or 90%) of the portion extending between the two ends of the traces 622 is positioned adjacent to the third surface 618. This portion of the conductive traces 622 may be secured to the third surface 618 using, for instance, a polymer layer.

Continuing, the light array 624 may be affixed to the second surface 616 of the first layer 610 in an exemplary aspect using, for instance, a polymer layer (not shown). To electrically couple the conductive traces 622 to the light array 624, a terminal end portion of the conductive traces 622 (e.g., a first end or a second end of the conductive traces 622) may extend across the space 613 between the two layers 610 and 612 before being electrically coupled to the light array 624 positioned adjacent the second surface 616. In exemplary aspects, the terminal end portion of the conductive traces 622 may be secured to the second surface 616 a predetermined distance before being coupled to the light array 624. In another exemplary aspect, the terminal end portion of the conductive traces 622 may be directly secured to the light array 624 without being secured to the second surface 616 of the first layer 610.

When the panel of material 600 is incorporated into an apparel item, the first surface 614 may comprise an outer-facing surface of the apparel item, and the fourth surface 620 may comprise an inner-facing surface of the apparel item. By positioning the conductive traces 622 on the "inner" layer 612, the outlines of the conductive traces 622 may be hidden from view when looking at the outer-facing surface of the apparel item. Moreover, by positioning the conductive traces 622 and the light array 624 in the space 613 between the two layers 610 and 612, wearer comfort is improved since the components are not directly adjacent to the wearer's skin surface. As mentioned, the panel of material 600 is joined to additional panels that are devoid of lighting components when forming an apparel item. These additional panels may comprise single layer panels which may reduce the overall weight of the apparel item.

In one exemplary aspect, and as shown in FIG. 6A, the light array 624 comprises the discrete visible light sources 625. Openings 626 may be formed through the first layer 610 and the light array 624 may be affixed to the first layer 610 such that one or more of the light sources 625 aligns with an opening 626 to provide a direct path of light transmission.

Figure 6B:
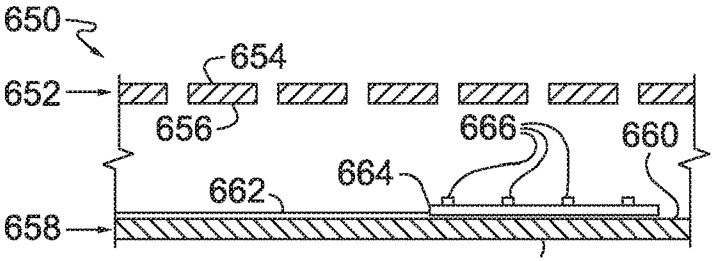
FIG. 6B illustrates a cross-sectional view of another exemplary configuration of conductive traces and a light array as positioned on a bi-layered panel of material in accordance with aspects herein.

Another exemplary configuration is depicted in FIG. 6B. FIG. 6B illustrates a panel of material 650 comprising a first layer 652 having a first surface 654 and an opposite second surface 656, and a second layer 658 having a third surface 660 and an opposite fourth surface 662. In exemplary aspects, the first layer 652 comprises a mesh material (knitted or woven) that has openings formed through, for instance, the knitting or weaving process. In this aspect, both conductive traces 662 and a light array 664 having visible light sources 666 may be secured or affixed to the third surface 660 of the second layer 658. Indirect light from the visible light sources 666 may be visible through the mesh material of the first layer 652. This may have the advantage of further hiding the components of the lighting system. Any and all aspects, and any variation thereof, are contemplated as being within aspects herein.

Figure 7:
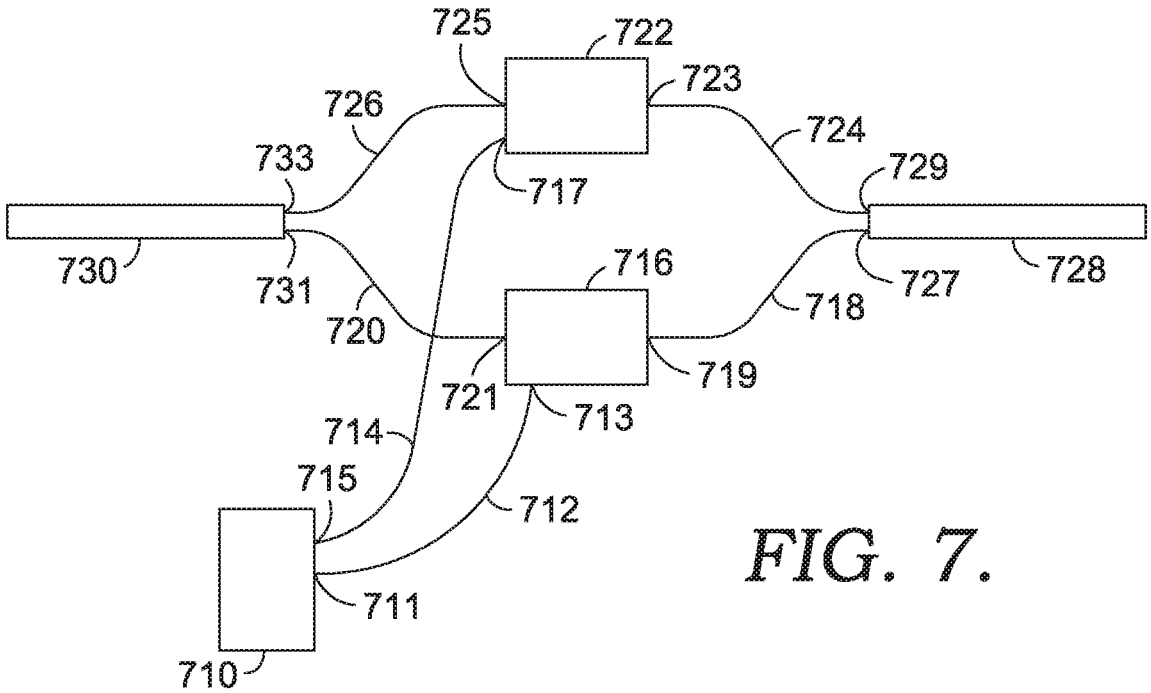
FIG. 7 illustrates an exemplary conductive trace configuration in accordance with aspects herein.

FIG. 7 illustrates an exemplary conductive trace configuration using junction areas in accordance with aspects herein. A power supply unit is indicated by reference numeral 710, a first light array is indicated by reference numeral 728, and a second light array is indicated by reference numeral 730. Reference numeral 716 denotes a first junction structure, and reference numeral 722 denotes a second junction structure. The first junction structure 716 and the second junction structure 722 together represent a junction area such as the junction area 332 of the apparel item 300 and the junction area 530 of the apparel item 500. The power supply unit 710, the first light array 728, and the second light array 730 may be positioned on the apparel item at different or disparate locations as shown for the apparel items 100, 300, and 500. Moreover, the first and second junction structures 716 and 722 may be positioned on the apparel item at a location different from that of the power supply unit 710 and the first and second light arrays 728 and 730.

As described above, having multiple sets of conductive traces extend from a single point such as the power supply unit 710 may create problems such as decreased pliability of the material at the area where the multiple sets of traces connect to the power supply unit 710, difficulty in construction, wearer discomfort, increased weight of the apparel item, and the like. To overcome this problem, it is contemplated herein that a single set of conductive traces 712 and 714 (e.g., a positive trace and a negative trace) may extend from the power supply unit 710. Since a single set of conductive traces would only power a single light array, it is necessary to introduce additional conductive traces to power additional light arrays. Use of the junction structures 716 and 722 solves this problem.

Figure 8:
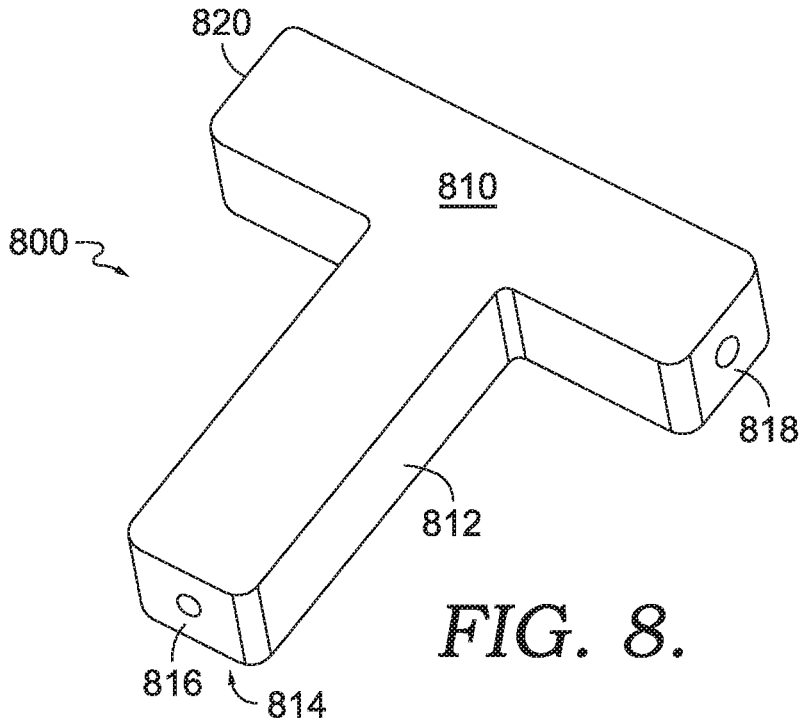
FIG. 8 illustrates an exemplary junction structure in accordance with aspects herein.

Before further describing FIG. 7, an exemplary junction structure will be described in relation to FIG. 8. FIG. 8 illustrates an exemplary junction structure 800 formed of a first electrically insulating polymer layer 810, an electrically conductive layer 812, and a second electrically insulating polymer layer 814, where the electrically conductive layer 812 is positioned between the first layer 810 and the second layer 814. In exemplary aspects, the conductive layer 812 may comprise a conductive fabric, a conductive ink, a conductive epoxy, and the like. The junction structure 800 may further optionally comprise one or more channels such as the channels 816, 818, and 820 (not seen because of the perspective view of FIG. 8) useable for receiving an end of a conductive trace. Once the ends of the conductive traces are received in the channels 816, 818 and 820, the electrically conductive layer 812 acts to electrically couple the traces.

The junction structure 800 may be manufactured or formed as a separate component that may be applied to apparel items in different locations depending on the particular trace configuration desired. To apply, the second polymer layer 814 may be affixed to the fabric of the apparel item using, for instance, a releasable or temporary adhesive. Conductive traces may be inserted into the channels 816, 818, and 820 and then heat may be applied to bond the second polymer layer 814 to the fabric of the apparel item and to bond the first polymer layer 810 to the second polymer layer 814 thereby sealing and electrically insulating the junction structure 800.

The shape of the junction structure 800 is exemplary only and it is contemplated that the junction structure 800 may assume different shapes such as a circle, a square, a diamond, and the like. It is further contemplated that the junction structure 800 may comprise more than three channels such that the junction structure 800 may be capable of electrically coupling more than three conductive traces.

In an exemplary aspect, an electrically conductive layer may not be utilized in the junction structure. In this aspect, the conductive traces may be directly coupled to one another to complete the electrical connection. The coupled traces could then be sandwiched between two layers of electrically insulating material such as the polymer layers 810 and 814 discussed above. Any and all aspects, and any variation thereof, are contemplated as being within aspects herein.

Returning to FIG. 7, a first end 711 of the conductive trace 712 is electrically coupled to the power supply unit 710, and a second end 713 of the conductive trace 712 may terminate at the junction structure 716 (i.e., may be received in a channel such as the channel 816 of FIG. 8). Similarly, a first end 715 of the conductive trace 714 is electrically coupled to the power supply unit 710, and a second end 717 of the conductive trace 714 may terminate at the junction structure 722. With respect to the junction structure 716, the conductive trace 712 may be electrically coupled using an electrically conductive material, such as the electrically conductive material of the conductive layer 812 of the junction structure 800, to a first end 719 of a conductive trace 718 and to a first end 721 of a conductive trace 720. The conductive traces 718 and 720 have the same polarity as the conductive trace 712. Similarly, with respect to the junction structure 722, the conductive trace 714 may be electrically coupled to a first end 723 of a conductive trace 724 and to a first end 725 of a conductive trace 726 where the conductive traces 724 and 726 share the same polarity as the conductive trace 714.

Continuing, second ends 727 and 729 of the conductive traces 718 and 724 respectively may be electrically coupled to the first light array 728, and second ends 731 and 733 of the conductive traces 720 and 726 respectively may be electrically coupled to the second light array 730. Thus, a single set of conductive traces, such as the conductive traces 712 and 714, may be used to power two different light arrays using the junction structures 716 and 722. As mentioned with respect to FIG. 8, junction structures may be used to electrically couple more than three conductive traces allowing a single set of conductive traces to power more than two light arrays. An example of this is shown with respect to the apparel item 300 where the conductive traces 326 are ultimately used to power the light arrays 318, 320, and 322 using the junction structures within the junction area 332.

Figure 12:
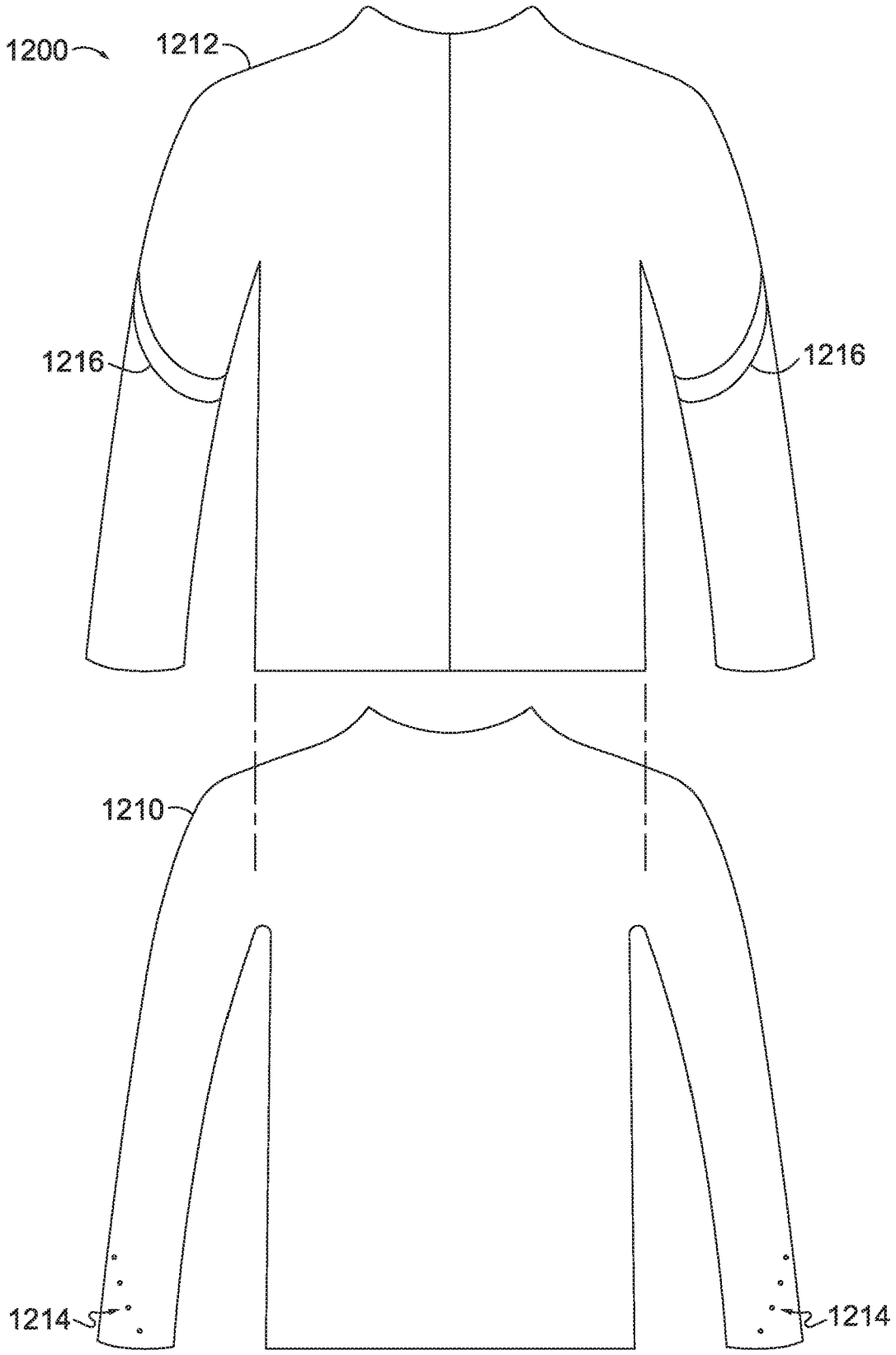
FIG. 12 illustrates an exemplary apparel system comprising a first layer apparel item having an integrated lighting system and a second layer apparel item in accordance with aspects herein.

Turning now to FIG. 12, an exemplary lighted apparel system 1200 is illustrated in accordance with aspects herein. The apparel system 1200 comprises a first layer apparel item 1210 and a second layer apparel item 1212. The first layer apparel item 1210 may comprise a base layer apparel item comprising a form-fitting apparel item meant to be worn adjacent to a wearer's skin. The first layer apparel item 1210 may also comprise a mid-layer apparel item that may be worn over a base layer but under, for instance, an outer layer. As shown in FIG. 12, the first layer apparel item 1210 may be in the form of a long-sleeved pullover top, although it is contemplated herein that the first layer apparel item 1210 may be in the form of a tight, pant, or other types of tops.

The second layer apparel item 1212 may comprise an external shell layer configured to provide protection from the elements. As shown in FIG. 12, the second layer apparel item 1212 may be in the form of a jacket although it is contemplated herein that the second layer apparel item 1212 may be in the form of a pullover top or as a pair of pants configured to be donned over, for instance, tights. The second layer apparel item 1212 may be formed of a wind resistant and/or water resistant material and/or may be formed of materials that provide insulation features to keep the wearer worn. In exemplary aspects, some or all of the second layer apparel item 1212 may be formed of a transparent, translucent, or nearly translucent material such as, for example, a lightweight nylon fabric.

In exemplary aspects, the first layer apparel item 1210 may comprise visible light sources 1214 positioned on the sleeve portions of the apparel item 1210 as described above for the apparel item 300 or the apparel item 500. When the first layer apparel item 1210 is worn, the light sources 1214 are configured to be positioned near the wrist areas of the wearer. Although not shown, the first layer apparel item 1210 may further comprise light sources positioned along a central back portion of the apparel item 1210 as described for the apparel item 300 and for the apparel item 500. The second layer apparel item 1212, in exemplary aspects, may comprise a reflective material 1216 such as a reflective strip positioned at a point approximately midway the length of the sleeve portions. When the second layer apparel item 1212 is worn, the reflective material 1216 may be positioned adjacent an elbow area of the wearer. In exemplary aspects, the second layer apparel item 1212 may be devoid of any visible light sources.

Figure 13:
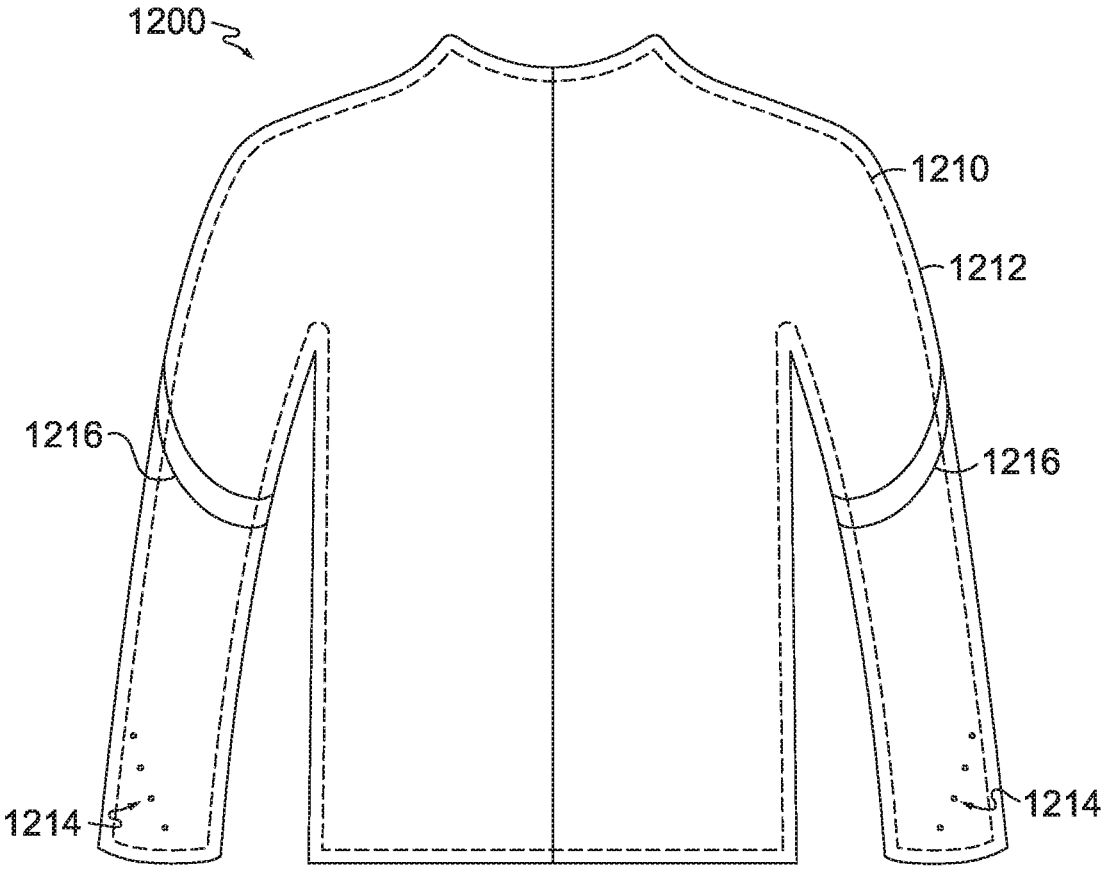
FIG. 13 illustrates the exemplary apparel system of FIG. 12 in an as-assembled configuration in accordance with aspects herein.

In exemplary aspects, the second layer apparel item 1212 is configured to be donned over the first layer apparel item 1210 when needed as shown in FIG. 13. Because some or all of the second layer apparel item 1212 is formed from a transparent, translucent, or nearly translucent material, the visible light sources 1214 remain visible even when the second layer apparel item 1212 is positioned over the first layer apparel item 1210. Moreover, the positioning of the reflective material 1216 on the second layer apparel item 1212 is meant to be complementary to the positioning of the light sources 1214 on the first layer apparel item 1210 such that both are visible when the apparel items 1210 and 1212 are worn together. To put it another way, the reflective material 1216 is positioned so that it does not obstruct or block the light emitted by the visible light sources 1214. Moreover, since both are positioned at locations corresponding to joint areas of the wearer, both the lights sources 1214 and the reflective material 1216 will undergo movement when the wearer exhibits, for instance, a running motion which facilitates the identity of the wearer as a human by persons viewing the apparel system 1200 in low light conditions. Other configurations of reflective materials are contemplated herein. For instance the reflective material 1216 may additionally, or alternatively, be positioned at a shoulder area of the second layer apparel item 1212. In another example, reflective materials may also be positioned on the first layer apparel item 1210 at, for example, the elbow and shoulder areas of the apparel item 1210 so that when the first layer apparel item 1210 is worn without the second layer apparel item 1212, additional visibility is imparted to the first layer apparel item 1210.

When the first layer apparel item 1210 is in the form of a tight, the light sources may be positioned at an ankle area of the apparel item such as shown for the apparel item 100. Similarly, when the second layer apparel item 1212 is in the form of a pant meant to be donned over the tight, the reflective material may be positioned at the knee and/or hip areas of the pant.

Aspects herein further contemplate that the second layer apparel item 1212 be formed of both translucent materials and more opaque materials. For example, sleeve portions, or parts of the sleeve portions, of the second layer apparel item 1212 may be transparent or translucent while some or all of the torso portions of the second layer apparel item 1212 may be formed of a more insulating—and hence more opaque—material. By configuring the sleeve portions of the second layer apparel item 1212 of a transparent or translucent material, the light sources 1214 positioned on the first layer apparel item 1210 remain visible when the second layer apparel item 1212 is donned over the first layer apparel item 1210. Any and all aspects, and any variation thereof, are contemplated as being within aspects herein.

Figure 9:
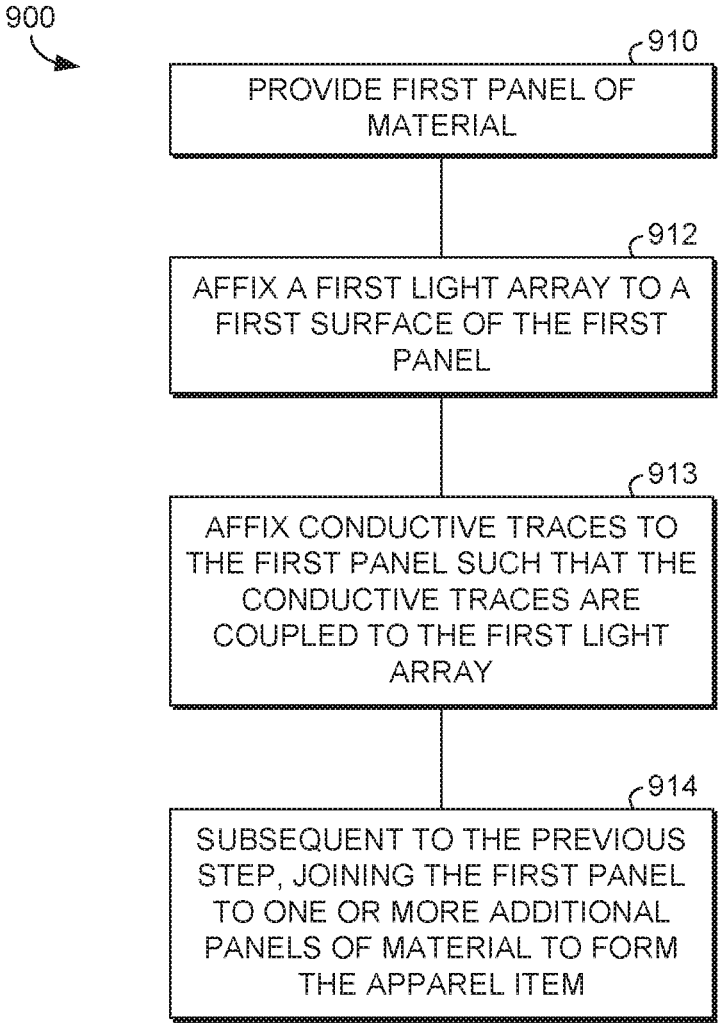
FIG. 9 illustrates an exemplary method of manufacturing a multi-panel apparel item having an integrated lighting system in accordance with aspects herein.

Turning now to FIG. 9, FIG. 9 illustrates a flow diagram of an exemplary method 900 of forming an apparel item having an integrated lighting system, such as the apparel item 100, 300 and/or 500, in accordance with aspects herein. At a step 910, a first panel of material is provided. In exemplary aspects, the first panel of material may comprise a double layer construction or a single layer construction. One or more light arrays may be affixed to a first surface, such as an inner-facing surface, of the panel of material at a step 912. And, at a step 913, conductive traces may be affixed to the first surface of the first panel of material and electrically coupled to the light arrays. Subsequent to the steps 910, 912, and 913, the first panel of material may be joined with one or more additional panels of material to form the apparel item. The one or more additional panels of material may comprise single layer constructions or multi-layer constructions.

Figure 10:
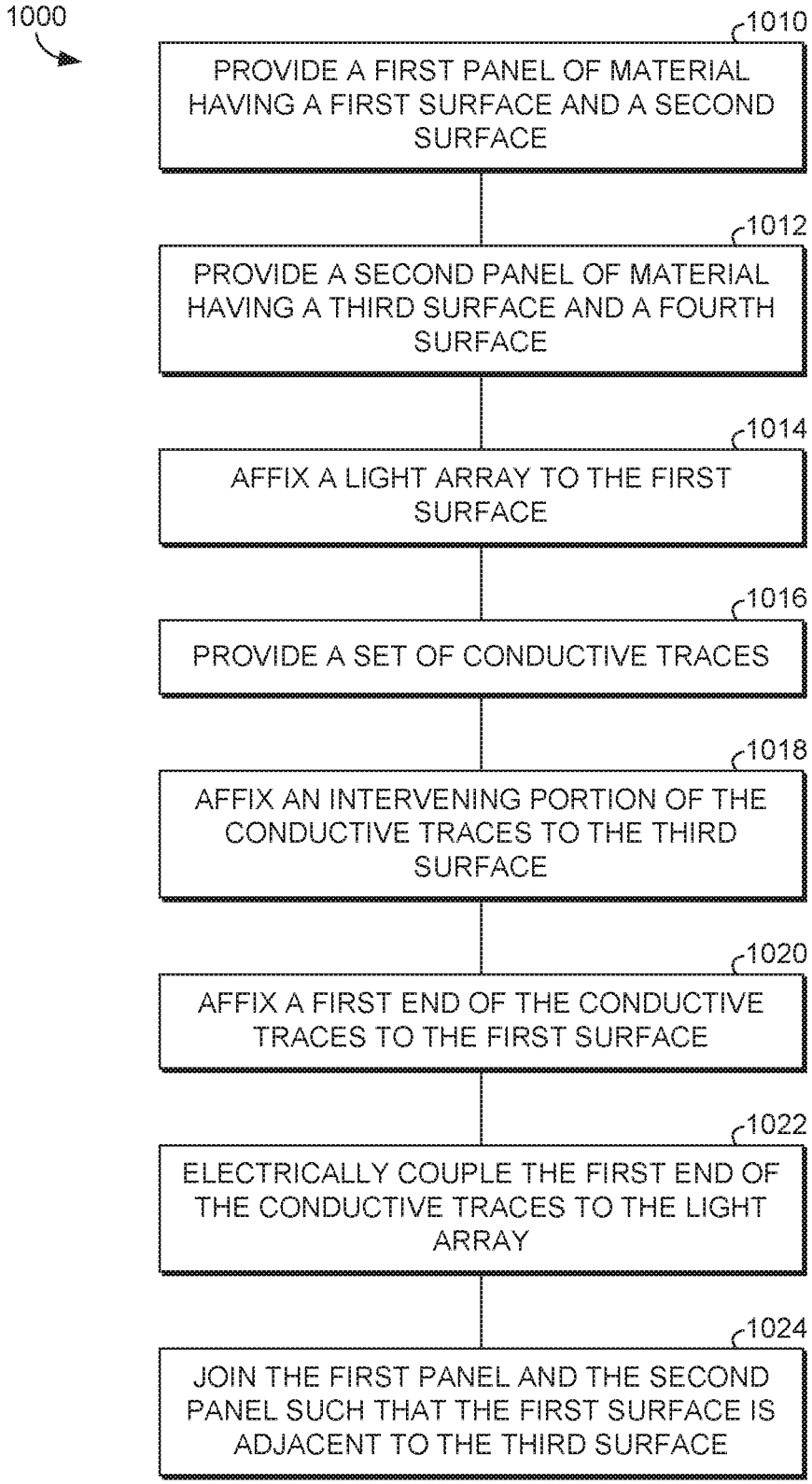
FIG. 10 illustrates an exemplary method of forming a panel of material having lighting system components in accordance with aspects herein.

FIG. 10 illustrates a flow diagram of an exemplary method 1000 of configuring lighting components on a panel of material to reduce the imprint or outline of the components when viewing the panel of material from its outer-facing surface. At a step 1010 a first panel of material is provided having a first surface and a second opposite surface, and at a step 1012, a second panel of material is provided having a third surface and a fourth opposite surface. At a step 1014, a light array having one or more visible light sources is affixed to the first surface of the first panel of material. At a step 1016, a set of conductive traces is provided each having a first end, a second end, and an intervening portion extending between the first and second ends. At a step 1018, the intervening portions of the conductive traces are affixed to the third surface of the second panel of material. At a step 1020, the first ends of the conductive traces are affixed to the first surface of the first panel of material adjacent to the light array. At a step 1022, the first ends of the conductive traces are electrically coupled to the light array. And, at a step 1024, the first and second panels are joined together along, for instance, their perimeter edges such that the first surface of the first panel of material is positioned adjacent to the third surface of the second panel of material and a space is maintained between the two surfaces. The first panel of material may then be combined with one or more additional panels of material to form an apparel item having an integrated lighting system.

Figure 11:
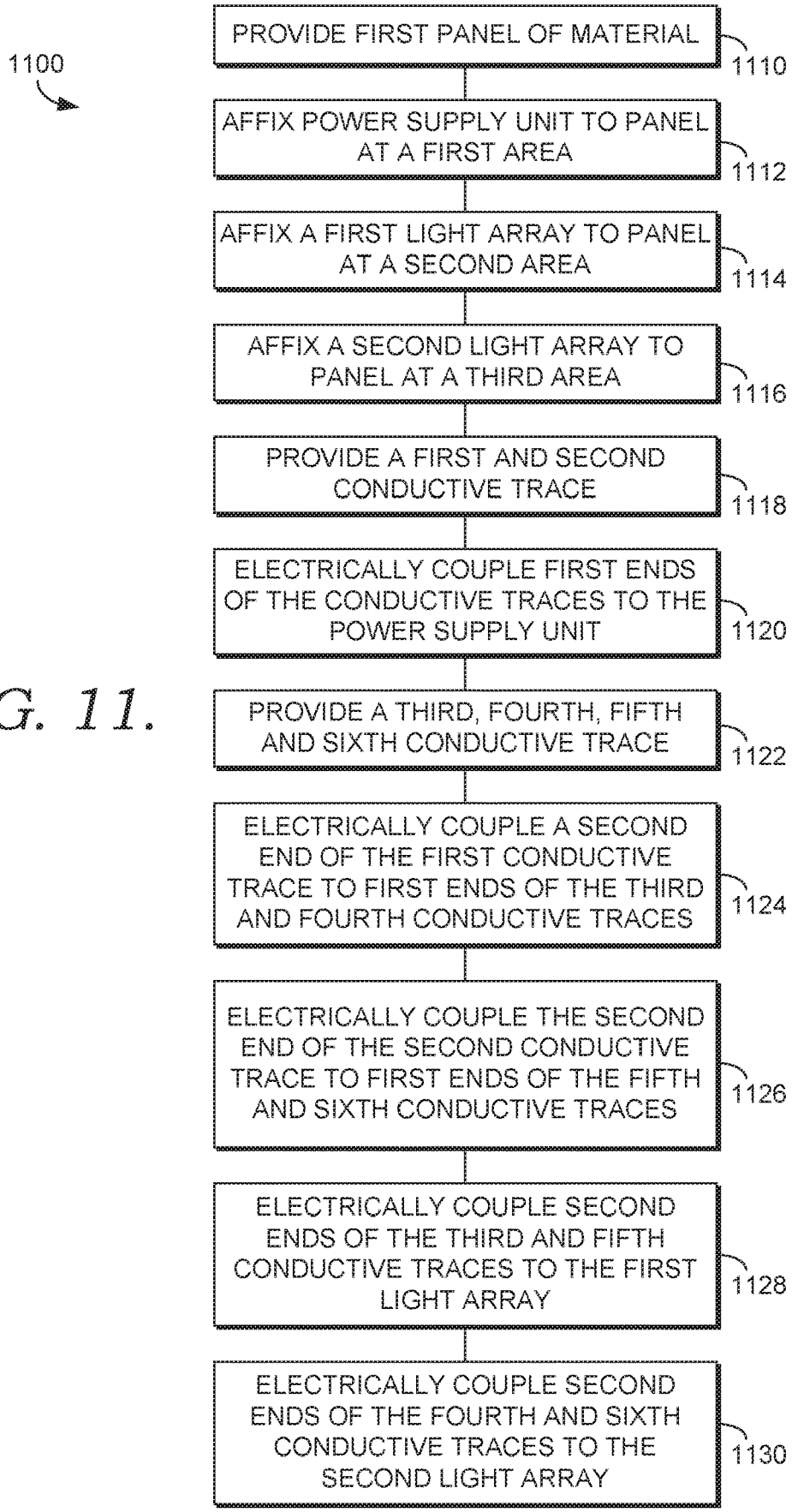
FIG. 11 illustrates an exemplary method of configuring lighting components on an apparel item in accordance with aspects herein.

FIG. 11 is a flow diagram of an exemplary method of configuring a trace configuration on an apparel item in accordance with aspects herein. At a step 1110, a first panel of material is provided, and at steps 1112, 1114 and 1116 respectively, a power supply unit is affixed to the panel at a first area, a first light array is affixed to the panel at a second area, and a second light array is affixed to the panel at a third area where the first, second, and third areas are located at different portions of the apparel item.

Continuing, at a step 1118, first and second conductive traces are provided each having first ends and second ends. At a step 1120, the first ends of the first and second conductive traces are electrically coupled to the power supply unit. At a step 1122, third, fourth, fifth, and sixth conductive traces are provided. At a step 1124, the second end of the first conductive trace is electrically coupled to the first ends of the third and fourth conductive traces at a first junction structure. And, at a step 1126, the second end of the second conductive trace is electrically coupled to the first ends of the fifth and sixth conductive traces. At a step 1128, the second ends of the third and fifth conductive traces are electrically coupled to the first light array, and, at a step 1120, the second ends of the fourth and sixth conductive traces are electrically coupled to the second light array.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. An apparel system having an integrated lighting system, the apparel system comprising:

a first layer apparel item comprising at least a first light array affixed to the first layer apparel item and located adjacent to a joint area of a wearer; and a second layer apparel item configured to be worn over the first layer apparel item and comprising one or more portions of reflective material, at least a portion of the second layer apparel item formed from a material that is substantially translucent, wherein the one or more portions of reflective material is located adjacent to the joint area of the wearer.

2. The apparel system of claim 1, wherein the first layer apparel item comprises a form-fitting layer.

3. The apparel system of claim 1, wherein the second layer apparel item is substantially impervious to water.

4. The apparel system of claim 1, wherein the first layer apparel item and the second layer apparel item are configured for an upper torso of a wearer.

5. The apparel system of claim 4, wherein the first layer apparel item comprises a torso portion, a first long sleeve portion, and a second long sleeve portion.

6. The apparel system of claim 5, wherein the first light array is positioned on the first long sleeve portion such that it extends from a posterior aspect of the first long sleeve portion, around a lateral aspect of the first long sleeve portion, to an anterior aspect of the first long sleeve portion.

7. The apparel system of claim 6, further comprising a second light array positioned on the second long sleeve portion such that it extends from a posterior aspect of the second long sleeve portion, around a lateral aspect of the second long sleeve portion, to an anterior aspect of the second long sleeve portion.

8. The apparel system of claim 7, wherein each of the first light array and the second light array are positioned near a cuff end of the first long sleeve portion and the second long sleeve portion respectively.

9. The apparel system of claim 8, further comprising a third light array positioned on a central back area of the torso portion.

10. The apparel system of claim 1, wherein the first layer apparel item further comprises one or more portions of reflective material.

11. The apparel system of claim 1, wherein the one or more portions of reflective material of the first layer apparel item is positioned at a distal end of an extremity portion of the first layer apparel item.

12. An apparel system having an integrated lighting system, the apparel system comprising:

a first apparel item comprising a torso portion, a first long sleeve portion, and a second long sleeve portion, wherein:

at least a first light array is affixed to the first long sleeve portion adjacent to a cuff end, and a reflective material is affixed to the first long sleeve portion adjacent to a joint area.

13. The apparel system of claim 12, wherein the reflective material comprises a reflective strip affixed to the first long sleeve portion and the second long sleeve portion of the first apparel item.

14. The apparel system of claim 12, wherein the reflective material is positioned at a shoulder area of the first long sleeve portion and the second long sleeve portion.

15. The apparel system of claim 12, wherein the reflective material is positioned at a shoulder area of the first apparel item.

16. The apparel system of claim 12, further comprising a second apparel item configured to be worn over the first apparel item, at least a portion of the second apparel item formed of a material that is substantially translucent.

17. The apparel system of claim 16, wherein the substantially translucent material is configured to be positioned adjacent to the first light array when the second apparel item is worn over the first apparel item.

18. The apparel system of claim 17, wherein the second apparel item is devoid of light arrays.

19. The apparel system of claim 12, wherein at least a second light array is affixed to the second long sleeve portion adjacent to a cuff end.

20. The apparel system of claim 19, wherein a reflective material is affixed to the second long sleeve portion at an area different from the second light array.

* * * * *